US006139061A

United States Patent [19]

Lewis

[11] Patent Number: 6,139,061

[45] Date of Patent: Oct. 31, 2000

[54] RIDE-ON TOY VEHICLE

[76] Inventor: Jeffrey Lewis, 24 Sylvan La., Old Greenwich, Conn. 06870

[21] Appl. No.: 09/138,273

[22] Filed: Aug. 21, 1998

[51] Int. Cl.[7] ..... A63G 13/00

[52] U.S. Cl. ..... 280/828

[58] Field of Search ..... 280/1.13, 828, 280/1.16, 1.22, 1.23, 827

[56] References Cited

U.S. PATENT DOCUMENTS

| | | | |
|---|---|---|---|
| 2,791,434 | 5/1957 | Wheeler | 280/1.22 |
| 3,137,510 | 6/1964 | Lemelson | 280/1.22 |
| 3,815,931 | 6/1974 | Morrison et al. | 280/1.201 |
| 4,023,816 | 5/1977 | Ellman et al. | 280/1.13 |
| 4,244,592 | 1/1981 | Lohr | 280/1.192 |
| 4,265,461 | 5/1981 | Okubo | 280/1.13 |
| 4,572,530 | 2/1986 | Marino | 280/1.188 |
| 4,667,975 | 5/1987 | Fabiano | 280/211 |
| 4,741,544 | 5/1988 | Kassai | 280/1.13 |
| 4,971,342 | 11/1990 | Dix et al. | 280/1.13 |
| 5,906,379 | 5/1999 | Kelle et al. | 280/1.204 |

*Primary Examiner*—Kevin Hurley
*Assistant Examiner*—Andrew J. Fischer
*Attorney, Agent, or Firm*—Hopgood, Calimafde, Kalil & Judlowe

[57] ABSTRACT

A ride-on toy vehicle for a pre-school child, the vehicle having a soft and compressible body which functions as a saddle. The body of the toy resembles an animal such as a sea turtle, or a familiar vehicle such as an ice cream truck. The body is mounted on a wheeled chassis whereby a child astride the body and holding onto a rein attached thereto can push and propel the ride-on vehicle with his feet. The chassis which accommodates the body includes parallel side walls having front and rear-end bearing holes. Bridging the parallel walls and passing through the front end bearing holes to join a pair of front wheels is a front axle. Bridging the parallel walls and passing through the rear end bearing holes to join a pair of rear wheels is a rear axle. The underside of the body is provided with front and rear channel pieces, the front axle extending through the front channel piece and the rear axle extending through the rear channel piece, thereby anchoring the body on the chassis.

7 Claims, 3 Drawing Sheets

RIDE-ON TOY VEHICLE

BACKGROUND OF INVENTION

1. Field of Invention

This invention relates generally to a ride-on toy vehicle for a pre-school child that is pushed and propelled by the feet of the child, and more particularly to a toy vehicle of this type having a soft and compressible body serving as a saddle anchored on a wheeled chassis, a child astride the body holding onto a rein attached thereto.

2. Status of Prior Art

The historic precursor of a vehicle in the form of a four-legged, animal-like figure on wheels is the legendary Trojan horse created by a large hollow wooden horse mounted on wheels. This horse, according to Homer, was wheeled into the open gates of Troy and had Greek warriors hidden in its torso.

A modern version of the Trojan horse popular with preschool children is constituted by a hollow, four-legged animal figure, such as one resembling a pony, molded of rigid synthetic plastic material. This plastic figure is mounted on four wheels to create a ride-on vehicle. The dimensions of the vehicle are such that a child astride the pony and holding onto its neck can reach the ground with his feet, and then use his feet to push and propel the toy vehicle.

While children enjoy playing with a ride-on toy vehicle of this type, for the child is then riding, as it were, on his own pony, the nature of this toy is such as to penalize the parents of the child. The term pre-school child, as used herein, refers to any child who is at least 2 years of age so that he is old enough to attend a kindergarten but not a regular school.

A 3-year old child when vigorously pushing an animal-like plastic figure on wheels in an indoor area will often collide with a wall and possibly with furniture in the path of this toy vehicle. The effect of a collision is usually not serious, but at the very least it will leave bump marks on the walls and furniture. But in some cases, when the toy vehicle is moving at a fairly high speed and collides with a wall, the child astride the vehicle will then be thrust forward and he may strike his head against the rigid head section of the plastic figure and be injured thereby.

SUMMARY OF INVENTION

In view of the foregoing, the main object of this invention is to provide a ride-on toy vehicle for a pre-school child having a soft and compressible body serving as a saddle for the child, the body being anchored on a wheeled chassis whereby a child astride the body can propel the vehicle with his feet.

More particularly, an object of this invention is to provide a ride-on vehicle of the above type in which the body resembles an animal-like figure such as a sea turtle, so that the child appears to be riding on the back of the turtle.

Also an object of the invention is to provide a ride-on toy vehicle of the above type in which the body resembles a familiar vehicle, but without wheels, such as a fire engine or ice-cream truck, whose wheels are supplied by the chassis wheels.

Yet another object of the invention is to provide a ride-on vehicle of the above type whose body is anchored on the chassis by front and rear channel pieces attached to the underside of the body, the front and rear wheel axles extending through corresponding channel pieces.

A significant advantage of a ride-on toy vehicle in accordance with the invention is that the soft body thereof acts to cushion the child astride the body and to provide a comfortable ride. And because the soft front end of the soft body projects forwardly beyond the front wheels and acts as a bumper, the vehicle is cushioned from collision with walls and furniture, thereby preventing bump marks or other damaging effects.

Briefly stated, these objects are attained by a ride-on toy vehicle for a pre-school child having a soft and compressible body which functions as a saddle. The body of the toy resemble an animal such as a sea turtle, or a familiar vehicle such as an ice cream truck. The body is mounted on a wheeled chassis whereby a child astride the body and holding onto a rein attached thereto can push and propel the ride-on vehicle with his feet.

The chassis which accommodates the body includes parallel side walls having front and rear end bearing holes. Bridging the parallel walls and passing through the front end bearing holes to join a pair of front wheels is a front axle. Bridging the parallel walls and passing through the rear end bearing holes to join a pair of rear wheels is a rear axle. The underside of the body is provided with front and rear channel pieces, the front axle extending through the front channel piece and the rear axle extending through the rear channel piece, thereby anchoring the body on the chassis.

BRIEF DESCRIPTION OF DRAWINGS

For a better understanding of the invention, as well as other objects and features thereof, reference is made to the accompanying drawings wherein.

DESCRIPTION OF INVENTION

Figure 1:
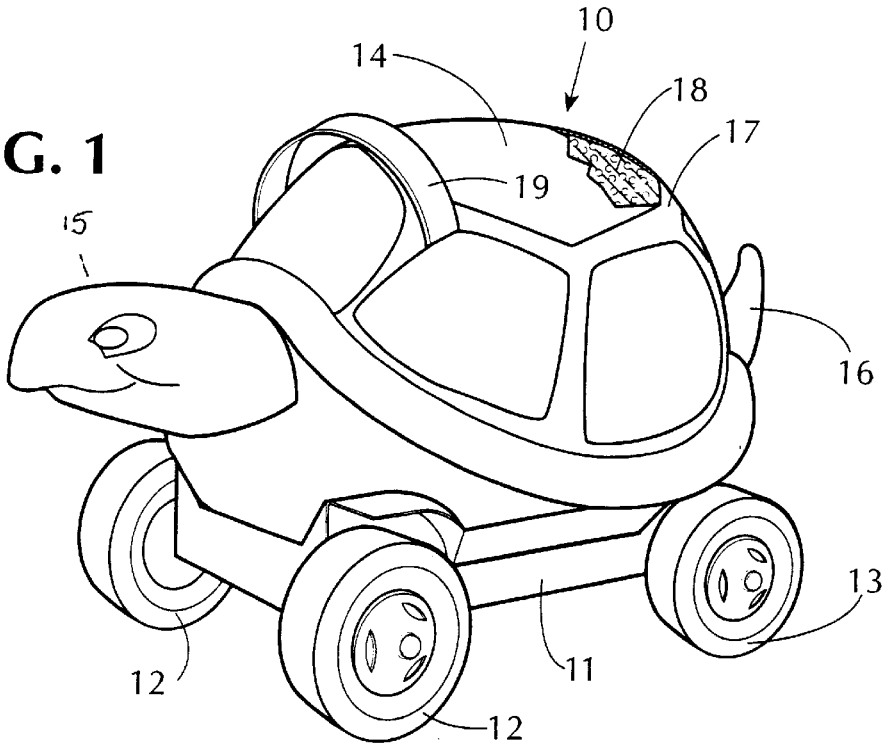
FIG. 1 is a perspective view of a first embodiment of a ride-on toy in accordance with the invention, the body of which resembles a sea turtle.
Figure 2:
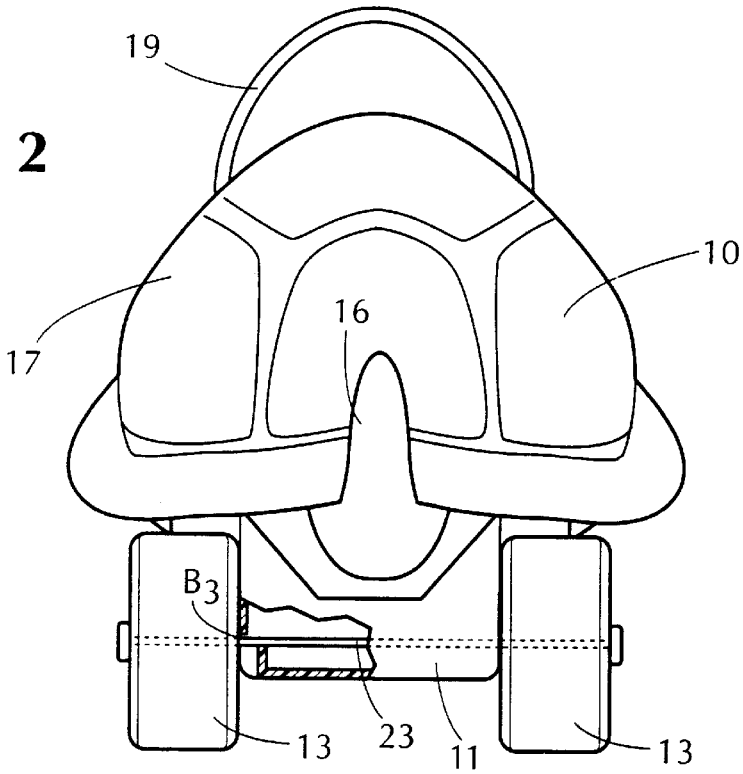
FIG. 2 is a rear view of the vehicle.

First Embodiment:

FIGS. 1 and 2 illustrate a ride-on vehicle in accordance with the invention that includes a soft and compressible body 10 anchored on a tray-like chassis 11 supporting a pair of front wheels 12 and a pair of rear wheels 13.

Body 10 which resembles a sea turtle has a dome-shaped shell 14, a head and neck 15 projecting forwardly beyond the front wheels, and a tail 16 extending rearwardly. Body 10 functions as a saddle for the pre-school child astride the body, so that the child appears to be riding on a turtle as he pushes and propels the turtle with his feet.

Body 10 is provided with an outer casing 17 formed of a flexible synthetic plastic material, such as polyethylene, that simulates soft leather. Casing 17 is stuffed with cotton batting 18 or a flexible foam plastic material, such as polyurethane, to render the turtle body soft and compressible. Attached to the front end of shell 14 is a U-shaped strap forming a rein 19 to be held by the child astride the turtle with his legs on opposite sides thereof.

Figure 3:
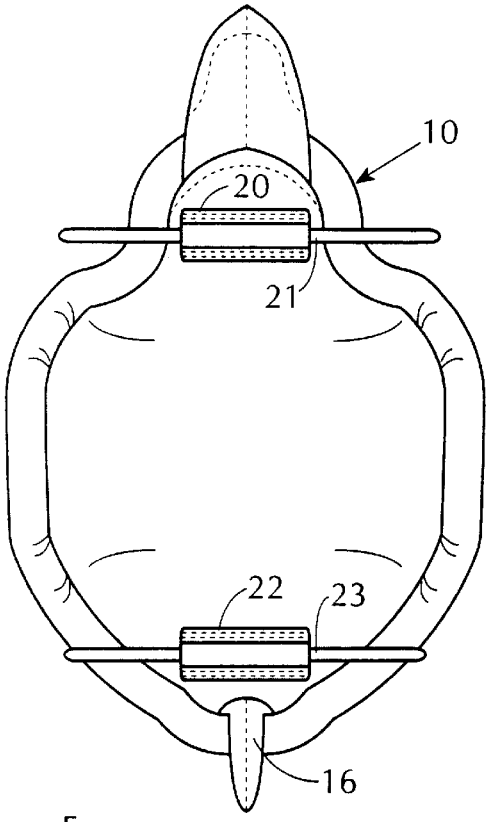
FIG. 3 shows the underside of the body.

As shown in FIG. 3, attached to the flat underside of the turtle body 10 adjacent its front end is a front channel piece 20 formed of woven nylon or other high-strength fabric adapted to receive a front axle 21 to which the front wheels 12 are joined. Also attached to the underside of the turtle body adjacent the rear end thereof is a rear channel piece 22 adapted to receive a rear axle 23 to which the rear wheels 13 are joined.

Figure 4:
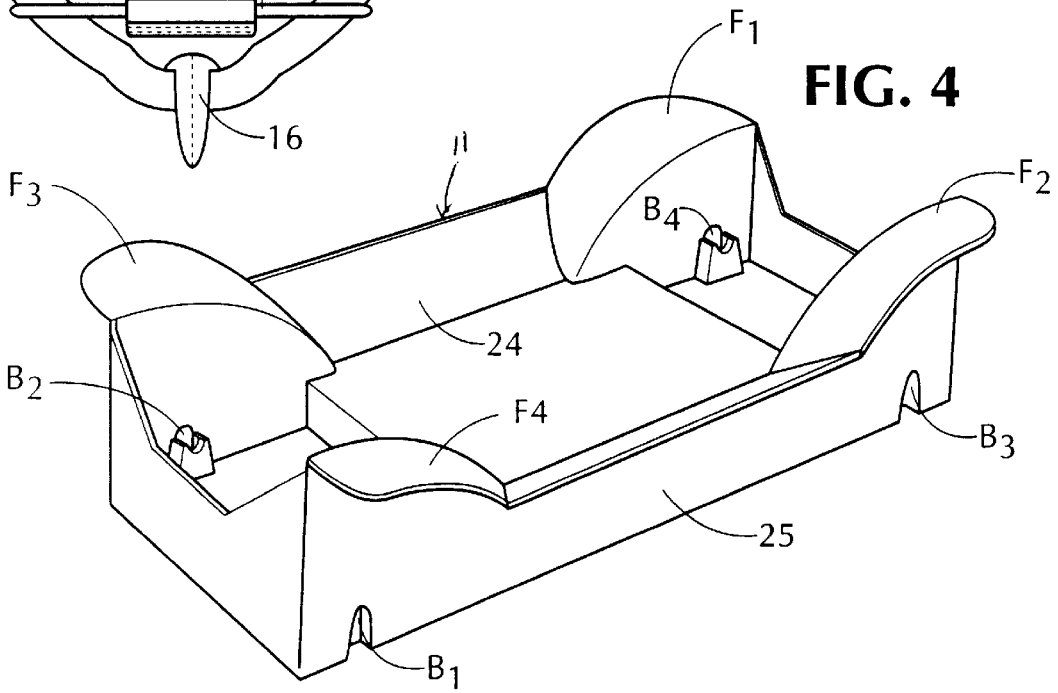
FIG. 4 illustrates the tray-like chassis of the vehicle in which the body is seated.
Figure 5:
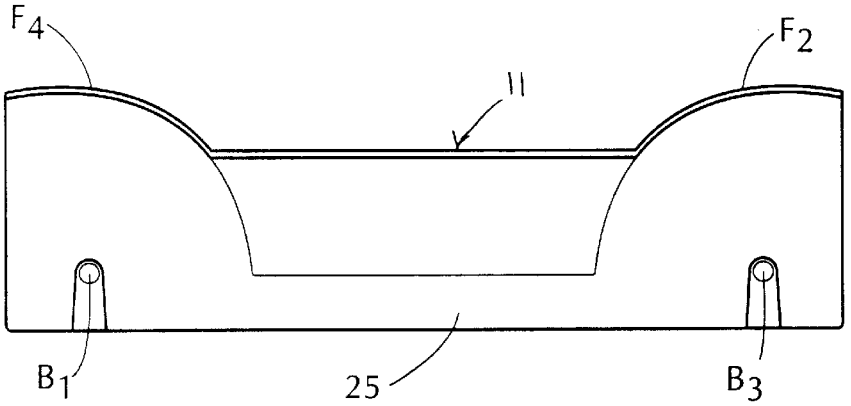
FIG. 5 is a side view of the chassis.

The tray-like chassis 11, as shown in FIGS. 4 and 5, is molded of high-strength synthetic plastic, such as polypropylene. The chassis includes parallel side walls 24 and 25 whose upper portions are contoured to define a pair of front fenders $F_1$ and $F_2$ to guard the front wheels 12, and a pair of rear fenders $F_3$ and $F_4$ to guard the rear wheels 13. The parallel walls 24 and 25 are provided adjacent the front end of the chassis with bearing holes $B_1$ and $B_2$, and adjacent the rear end with bearing holes $B_3$ and $B_4$.

Figure 6:
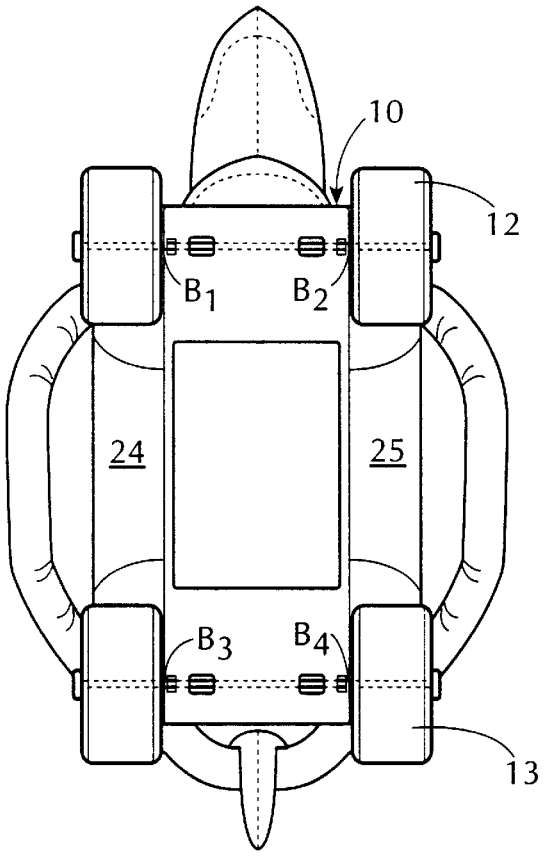
FIG. 6 shows the underside of the vehicle.

As shown in FIG. 6, front axle 21 which passes through channel piece 20 on the underside of body 10 bridges side walls 24 and 25 of the chassis and extends through bearing holes $B_1$ and $B_2$ to join front wheels 12 which are rotatable on the axle. Rear axle 23 bridges side walls 24 and 25 of the chassis to join rear wheels 13, the axle passing through channel piece 22. Hence body 10 of the ride on vehicle which is seated on the chassis is securely locked thereto so that it cannot be separated from the chassis.

The arrangement is such that the toy is easily assembled, for it is only necessary to seat the body of the chassis so that the channel pieces on the underside thereof are in line with the front and rear bearing holes and to then insert the front and rear axles through the bearing holes and the channel pieces, after which the front and rear wheels are attached to the opposite ends of the axles projecting through the bearing holes.

The toy is safe and comfortable for pre-school children, for a child astride the soft and compressible body which serves as a saddle is at a height which permits the rider to reach the ground with his feet to push and propel the vehicle as he holds onto the rain. Should the child collide with a wall in the playroom or wherever else he is playing with the toy, the projecting head end of the soft body acts as cushioned bumper to avoid damaging the wall or object struck by the toy vehicle.

Other Embodiments:

The body of the ride-on vehicle may be in any animal-like form, such as a swan or duck, so that the pre-school child then appears to be riding this animal. However, the child may prefer not to be riding an animal, but a vehicle with which he is familiar, such as a fire engine, a garbage truck or a sports car.

Figure 7:
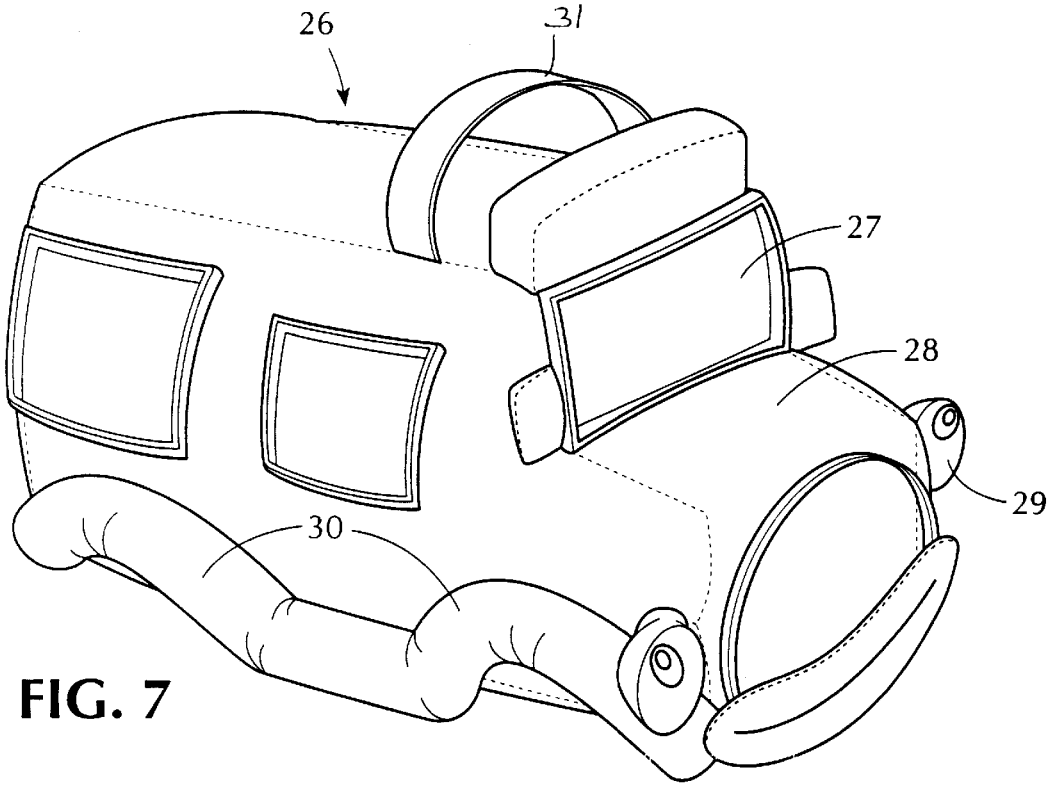
FIG. 7 illustrates the body of another embodiment of the vehicle which resembles an ice-cream truck.

FIG. 7 illustrates one such vehicle which forms the soft and compressible body 26 of a ride-on toy vehicle in accordance with the invention in which body 26 resembling a vehicle is anchored on a wheeled chassis.

Body 26 is fabricated of an outer leather-like casing which is stuffed with compressible material in the same manner as the turtle body 10 shown in FIG. 1. However, body 26 simulate the appearance of an ice cream truck having a generally rectangular cabin 27 and an engine compartment 28 provided with headlights 29.

Body 26 is provided with scalloped edges 30 on either side thereof that define the fenders of the vehicle which guard the front and rear wheels supported on the chassis. And a strap 31 attached to the roof of cabin 27 serves as the rein of the vehicle body when a child is astride the body.

Body 26 is provided at its underside with channel pieces as in FIG. 3 to anchor the body to the chassis.

While there have been disclosed preferred embodiments of a ride-on toy vehicle in accordance with the invention, it is to be understood that many changes may be made therein without departing from the spirit of the invention. Thus the soft body of the vehicle may be in any humanoid or animal-like form or may resemble familiar objects, such as full-scale vehicles. And instead of channel pieces attached to the underside of the soft body to receive the front and rear axles of the vehicle and thereby anchor the body on the chassis, use may be made of flexible tabs extending from the underside of the body provided at their free ends with grommets to receive the axles.

I claim:

1. A ride-on toy vehicle adapted to accommodate a pre-school child comprising:

A. a chassis having parallel side walls provided with front-end and rear-end bearing holes;

B. a front axle bridging the side walls and extending through the front-end bearing holes to join a pair of front wheels;

C. a rear axle bridging the side walls and extending through the rear-end bearing holes to join a pair of rear wheels; and D. a soft and compressible body having an underside anchored on the chassis and shaped to serve as a saddle for a child when astride the body, the child then reaching the ground with his feet and holding onto a rein attached to the body whereby when the child is astride the body the child is then able to propel the vehicle with his feet; and E. means engaging the front axle and the rear axle to secure the underside of the body to the chassis, thereby anchoring the body on the chassis.

2. A ride-on vehicle as set forth in claim 1, in which the body has a cushioned projection extending from its front end to serve as a protective bumper.

3. A ride-on toy vehicle as set forth in claim 2 in which the body resembles an animal whose head acts as the cushioned projection.

4. A ride-on vehicle as set forth in claim 3, in which the animal is a sea turtle.

5. A ride-on vehicle as set forth in claim 1, in which said parallel side walls of the chassis are contoured to define front and rear fenders to guard the front and rear wheels.

6. ride-on vehicle as set forth in claim 1, in which the body in anchored on the chassis by means secured to the underside of the body and engaging said front and said rear axles.

7. A ride-on vehicle as set forth in claim 5, in which said means are constituted by front and rear channel pieces, the front axle extending through the front piece and the rear axle, extending through the rear pieces.

* * * * *